US008816255B2

(12) United States Patent
Lee et al.

(10) Patent No.: US 8,816,255 B2
(45) Date of Patent: Aug. 26, 2014

(54) SURFACE HEATER USING STRIP TYPE SURFACE HEATING ELEMENT AND FABRICATING METHOD THEREOF

(75) Inventors: Jae Yeong Lee, Seoul (KR); Hyun Chul Lim, Gwangmyeong-si (KR); Sung Chul Yang, Seoul (KR); Sang Dong Jeong, Gimpo-si (KR); Soung Ho Jang, Gimpo-si (KR)

(73) Assignee: Amogreentech Co., Ltd. (KR)

( * ) Notice: Subject to any disclaimer, the term of this patent is extended or adjusted under 35 U.S.C. 154(b) by 855 days.

(21) Appl. No.: 12/747,965

(22) PCT Filed: Dec. 12, 2008

(86) PCT No.: PCT/KR2008/007357

§ 371 (c)(1),
(2), (4) Date: Jul. 29, 2010

(87) PCT Pub. No.: WO2009/078622

PCT Pub. Date: Jun. 25, 2009

(65) Prior Publication Data

US 2010/0288752 A1 Nov. 18, 2010

(30) Foreign Application Priority Data

Dec. 14, 2007 (KR) ..... 10-2007-0131363

(51) Int. Cl.
*H05B 1/00* (2006.01)
*H05B 11/00* (2006.01)
*H05B 3/24* (2006.01)

(52) U.S. Cl.
CPC ..... *H05B 3/24* (2013.01)
USPC ..... 219/528; 219/542; 219/544; 219/549; 219/645; 219/546

(58) Field of Classification Search
USPC ..... 219/542, 544, 546, 549, 528, 645
See application file for complete search history.

(56) References Cited

U.S. PATENT DOCUMENTS

| | | | | |
|---|---|---|---|---|
| 3,872,281 | A * | 3/1975 | Krieg et al. | 219/535 |
| 4,281,238 | A * | 7/1981 | Noma et al. | 219/535 |
| 5,239,614 | A | 8/1993 | Ueno et al. | |
| 5,808,281 | A * | 9/1998 | Matsen et al. | 219/634 |
| 6,225,608 | B1 * | 5/2001 | Kallgren | 219/465.1 |

(Continued)

FOREIGN PATENT DOCUMENTS

| | | |
|---|---|---|
| JP | 05-021138 | 1/1993 |
| JP | 2004-063276 | 2/2004 |

(Continued)

OTHER PUBLICATIONS

International Search Report—PCT/KR2008/007357 dated Jun. 26, 2009.

*Primary Examiner* — Nitin Parekh
(74) *Attorney, Agent, or Firm* — Cantor Colburn LLP

(57) ABSTRACT

Provided is a surface heater using a strip type surface heating element and a fabricating method thereof, in which the surface heater can be embodied into a thin film form using a metallic surface heating element which has a specific resistance value appropriate as a heat wire and is formed of a strip style, where the strip type surface heating element can be sequentially produced at an inexpensive cost. The surface heater includes: the strip type surface heating element in which a number of strips which are obtained by slitting a metallic thin film are arranged with an interval in parallel with each other and both ends of each adjacent strip are connected with each other; and an insulation layer which is coated on the outer circumference of the strip type surface heating element in a plate form.

4 Claims, 9 Drawing Sheets

(56) References Cited

U.S. PATENT DOCUMENTS

| | | | | |
|---|---|---|---|---|
| 2007/0235444 | A1* | 10/2007 | Lewin | 219/602 |
| 2009/0107983 | A1* | 4/2009 | Horsmann et al. | 219/520 |

FOREIGN PATENT DOCUMENTS

| | | |
|---|---|---|
| KR | 10-1993-0021022 | 10/1993 |
| KR | 20-0137043 | 5/1999 |
| KR | 10-0217542 | 9/1999 |
| KR | 20-0219527 | 4/2001 |
| KR | 20-0277428 | 6/2002 |
| KR | 20-0285485 | 8/2002 |
| KR | 20-0293218 | 10/2002 |
| KR | 10-0544664 | 1/2006 |

* cited by examiner

SURFACE HEATER USING STRIP TYPE SURFACE HEATING ELEMENT AND FABRICATING METHOD THEREOF

TECHNICAL FIELD

The present invention relates to a surface heater using a strip type surface heating element and a fabricating method thereof. More particularly, the present invention relates to a surface heater using a strip type surface heating element and a fabricating method thereof, in which the surface heater can be embodied into a thin film form using a metallic surface heating element which has a specific resistance value appropriate as a heat wire and is formed of a strip style, where the strip type surface heating element is appropriate for a low temperature heating purpose.

BACKGROUND ART

In general, since water pipes which are installed at homes, office buildings, or factories, or pipes which transfer various kinds of solutions at factories are inevitably exposed to the outside, in particular, in the air, they may be frozen to burst unless they have heating facilities, respectively.

In high-volume mass production systems of recent frontier industries, temperature, flux or quantity of flow, pressure, level, etc., should be controlled precisely and quickly because they decisively influence upon productivity, quality, etc. Accordingly, a flux transmitter and a pressure transmitter are the most important fields in a manufacturing process. Here, it should be measured along all lines of pipes whether how much flux has flown in the respective pipes or how much pressure has occurred therein. The flux transmitter and the pressure transmitter receive analog signals resulting from the measured fluxes and pressures, in a differential pressure form, and send the received analog signals to a controller to thus control valves.

For this, a heater cable is attached to and installed in an induced pressure pipe line through which flux and pressure of liquid are detected. Then, electricity is supplied through the heater cable, to thus maintain the induced pressure pipe line at 30° C. to 50° C. By doing so, it is required that the induced pressure pipe line should be anti-frozen and accurate flux and pressure should be detected.

According to the conventional art, water pipes which are installed at homes, office buildings, or factories, or pipes which transfer various kinds of solutions at factories, employ various kinds of anti-freezing heaters, in order to prevent the pipes from being frozen to burst.

Korean Utility-model Registration No. 219527 discloses an anti-freezing heater whose heat resistance or durability are excellent and whose cost can be saved. For this, the anti-freezing heater disclosed in Korean Utility-model Registration No. 219527 is configured to includes a heat wire which is connected to an electric power supply cable to emit heat, an inner coat layer made of a silicon material which is coated around the circumference of the heat wire, and an outer coat layer made of a PVC material which is coated to surround the inner coat layer.

The conventional anti-freezing heater disclosed in the Korean Utility-model Registration No. 219527 uses a circular nichrome wire as a heat wire. Since the conventional anti-freezing heater has a small resistance value and emits heat at high temperature, temperature around the heat wire becomes high. Accordingly, there is a defect that the inner coat layer made of the silicon material whose heat resistance is excellent should be necessarily coated thickly around the heat wire. In addition, since the thick outer coat layer surrounds the outer portion of the inner coat layer, and thus the whole thickness is formed of a thick structure of about 3 mm for example, flexibility of the anti-freezing heater is low. As a result, when the anti-freezing heater is wound on a pipe, cohesiveness drops. Further, a heat transfer efficiency that heat emitted from a heat wire is transferred to a pipe becomes low due to a thick coat layer, together with inferiority of the cohesiveness. Still further, since the surface heater uses a nichrome wire which is expensive as a heat wire material, the total cost increases.

In addition, Korean Utility-model Registration No. 293218 discloses a linear heater where a bundle of a conductive fiber and a heat wire are linearly closely adhered and are coated by a coating material, in which the heat wire is wound at predetermined pitch intervals along the outer circumferential surface of the bundle of the fiber.

The linear heater disclosed in the Korean Utility-model Registration No. 293218 uses the heat wire made of a nichrome wire of a fine diameter. Accordingly, the heat wire may be considerably highly cut off. The linear heater is thickly formed of 2 mm thick and 10 mm wide. As a result, when the linear heater is wound on a pipe, cohesiveness drops. Further, a heat transfer efficiency that heat emitted from a heat wire is transferred to a pipe becomes low.

Korean Utility-model Registration No. 137043 discloses a self-controllable polymer heater which is configured to form a conductive coating layer between a conductor and a heating element, in order to play a role of supplementing limited cohesive power between the conductor and the heating element in the conventional self-controllable polymer heater. Accordingly, an increase of an interface resistance is minimized during use between the conductor and the heating element, to thus improve a long-term output stability.

The conventional self-controllable polymer heater disclosed in the Korean Utility-model Registration No. 137043 is thickly formed since it is formed of 3 mm thick and 10 mm wide. As a result, when the self-controllable polymer heater is wound on a pipe, cohesiveness drops. Further, a heat transfer efficiency that heat emitted from a heat wire is transferred to a pipe becomes low.

Meanwhile, Korean Utility-model Registration No. 277428 discloses an anti-freezing heater in which a plug is installed at one side of a cord wire, and a soft insulation coat layer is formed at the other side of the cord wire, a bimetal unit which is an electric current interruption unit is provided in the middle of the cord wire, and then a heat wire containing a heater wire is wound around a water pipe to thus prevent the water pipe from being frozen to burst. Here, the heat wire is wound around the water pipe and the bimetal unit is closely adhered to the water pipe through a space between the wound heat wire.

Most of the above-described anti-freezing heaters use the linear heating element formed of a nichrome wire or heat wire material having a circular cross-section. Accordingly, a thick coating layer is formed on the outer circumference of the heating element, in order to solve a problem due to excess and/or high temperature heat emission. In addition, a thick jacket or cord is disposed between a pair of the heating elements, in order to integrate the pair of the heating elements.

As a result, the whole flexibility of the conventional anti-freezing heater is low. Accordingly, when the anti-freezing heater is wound on a pipe, cohesiveness and workability drop. Further, a heat transfer efficiency that heat emitted from a heat wire is transferred to a pipe becomes low due to inferiority of the cohesiveness and the thick coating layer. Still further, a maintenance cost becomes high, and a manufacturing cost becomes also high.

Meanwhile, a freezer in a refrigerator is provided with a defrost heater such as an electric heater in order to remove frost that is formed on an evaporator. The defrost heater has used a tubular heater such as a sheath or jacket heater that generates heat up to about 600° C. However, since the conventional defrost heater generates heat up to high temperature in common, a safety problem may happen. In addition, since a temperature response performance is low, an electric power supply for the defrost heater is turned off and a compressor operates, immediately after a defrost operation has come to an end. Accordingly, a cooling period of time during which temperature of a refrigerant pipe is low to a point in time at which a refrigerating cycle of a freezer is substantially reactivated, that is, down to 0° C., is long. That is, a temperature response performance of the heater is slow. As a result, the entire defrosting cycle is prolonged. That is, if the defrosting cycle is prolonged, the freezer in the refrigerator cannot be converted into the refrigerating cycle immediately after the defrosting cycle has ended. Therefore, there may be a problem that the freezing performance falls.

DISCLOSURE

Technical Problem

To solve the above problems, it is an object of the present invention to provide a surface heater using a strip type surface heating element and a fabricating method thereof, in which the surface heater can be embodied into a thin film form using a metallic surface heating element which has a specific resistance value appropriate as a heat wire and is formed of a strip style, where the strip type surface heating element is appropriate for a low temperature heating purpose.

It is another object of the present invention to provide a surface heater which is embodied in a thin film form when the surface heater is used as an anti-freezing heater, to thus provide an excellent workability and cohesiveness with respect to a pipe.

It is still another object of the present invention to provide a surface heater and a fabricating method thereof, which uses an inexpensive Fe-based amorphous thin film ribbon material which can be inexpensively fabricated by a sequential production method by using an inexpensive metallic material such as Fe, instead of using an expensive metallic material such as Ni.

It is yet another object of the present invention to provide a surface heater and a fabricating method thereof, which can be fabricated in a broad width so as to be appropriate for preventing a pipe whose diameter is large and length is long from being frozen to burst.

It is still yet another object of the present invention to provide a surface heater and a fabricating method thereof, which uses a heating element and a coating layer having an elasticity and thus can be fabricated in a spiral form, to thus provide a very easy and fast winding work with respect to a pipe and thereby provide an excellent workability.

It is a further object of the present invention to provide a surface heater using a strip type surface heating element, in which a heating element is embodied in a thin film strip type surface-shaped form, to thus widen a contact area where the heating element contacts fluid in the pipe, and to thereby heighten a heat transfer efficiency and reduce electric power consumption.

It is a still further object of the present invention to provide a surface heater for defrost, which employs a metal thin film surface heating element having a high temperature response performance and a low thermal density to thus make the heater excellent in view of safety since temperature on the surface of the heater is enough lower than an ignition point of a pro-environmental refrigerant, and whose temperature rapidly rises up at the time of performing a defrosting cycle and which is rapidly cooled at the time of completion of the defrost cycle, to thus quickly resume a refrigerating cycle and greatly shorten time required for the defrosting cycle.

It is a yet further object of the present invention to provide a slim surface heater for defrost, which employs a surface heating element having a low thermal density to emit heat at low temperature to thereby make an insulation layer into a thin film and to thus embody a slim heater, and whose heat transfer efficiency is high to thus maximize an electric power to heat conversion efficiency.

It is a still yet further object of the present invention to provide a surface heater for use in a Kimchi refrigerator where the Kimchi represents one of the Korean traditional fermentation foods, to enable a quick temperature control according to change of a mode such as ripening and keeping of Kimchi stored in a store room of the Kimchi refrigerator, using characteristics of a metal thin film surface heater having a high temperature response performance and a low thermal density, and to increase a contact area where Kimchi contacts heat to maximize a heating efficiency of the heater.

Technical Solution

To accomplish the above objects of the present invention, according to an aspect of the present invention, there is provided a surface heater comprising:

a strip type surface heating element in which a number of strips which are obtained by slitting a metallic thin film are arranged with an interval in parallel with each other and both ends of each adjacent strip are connected with each other; and an insulation layer which is coated on the outer circumference of the strip type surface heating element in a plate form.

Preferably but not necessarily, the strip type surface heating element is made of an amorphous strip or FeCrAl.

More preferably but not necessarily, the amorphous strip can be made of a Fe-based alloy material.

In this case, it is desirable that the amorphous strip is established into 10-50 μm thick, and the heater is 0.2-1 mm thick.

Preferably but not necessarily, the surface heater is manufactured in a spiral form for the purpose of anti-freezing, to accordingly further improve workability and cohesiveness.

Preferably but not necessarily, the ends of the respectively adjacent strips are connected in series using an electric current interruption unit which operates in a preset temperature range.

Preferably but not necessarily, the surface heater further comprises a heat radiator plate which is adhered to one side surface of the insulation layer to thus transfer heat to an object in a uniform thermal conduction method.

According to another aspect of the present invention, there is provided a surface heater comprising:

a number of amorphous strip type surface heating elements in which a number of strips which are obtained by slitting an amorphous thin film are arranged with an interval in parallel with each other and which emit heat when electric power is applied to the strips;

a strip type insulation layer which is coated on the outer circumference of the number of the amorphous strip type surface heating elements which have been arranged in parallel with each other in a plate form; and a serial connection unit which is combined on the outer portion of one side end of the strip type insulation layer and connects the adjacent strips of the number of the amorphous strip type surface heating elements in series.

Preferably but not necessarily, the serial connection unit comprises:

a housing having a rectangular groove at one side thereof and into which one end of the strip type insulation layer which has been coated on the outer circumference of the number of the amorphous strip type surface heating elements is inserted; and a number of conductive connectors having a pair of stoppers which are integrated with the housing in the inside of the groove and penetrate the insulation layer when the strip type insulation layer which has been inserted into the inside of the groove is withdrawn again, to thus connect ends of a mutually adjacent strip pair among the number of the strips which have been arranged in parallel with each other, respectively.

According to still another aspect of the present invention, there is also provided a method of fabricating a surface heater, the surface heater fabrication method comprising the steps of:

forming a broad width surface heating element material of a ribbon shape made of a metallic thin film from an amorphous alloy by using a liquid rapid cooling method;

slitting the ribbon shape broad width surface heating element material so as to form a strip type surface heating element in which a number of strips are connected in series with each other; and overlapping an insulation film on the upper and lower sides of the strip type surface heating element, respectively and thus performing a laminating process.

Preferably but not necessarily, the step of performing the laminating process comprises the sub-step of: using rolls in which diameters of upper and lower rolls differ from each other; and performing a heating process and a pressurizing process in a slant direction with respect to the rotating axis of the rolls.

Preferably but not necessarily, the heater is formed in a spiral shape.

Preferably but not necessarily, the step of forming the strip type surface heating element comprises the sub-steps of:

forming one or more blanks in parallel at every unit length in the lengthy direction on the ribbon shape broad width surface heating element material;

cutting the ribbon shape broad width surface heating element material into unit length ribbon shape broad width surface heating elements along a cutting line when the rear end of the blank-formed ribbon shape broad width surface heating element material is transferred; and punching regions which are located in the lengthy direction from even-numbered blanks at one side end of the unit length ribbon shape broad width surface heating elements, and punching regions which are located in the lengthy direction from odd-numbered blanks at the other side end thereof, to thereby form the strip type surface heating element in which the number of the strips are connected in series with each other.

According to yet another aspect of the present invention, there is also provided a method of fabricating a surface heater, the surface heater fabrication method comprising the steps of:

slitting a ribbon shape broad width surface heating element material made of a metallic thin film to thereby prepare a number of strips; and laminating the number of the strips between upper and lower insulation films of a ribbon shape, wherein the laminating step comprises the sub-step of: using rolls in which diameters of upper and lower rolls differ from each other; and performing a heating process and a pressurizing process in a slant direction with respect to the rotating axis of the rolls.

Preferably but not necessarily, the heater is formed in a spiral shape.

Preferably but not necessarily, the amorphous strip is established into 10-50 μm thick, and the heater is 0.2-1 mm thick.

Advantageous Effects

Therefore, the present invention provides a surface heater which is embodied in a thin film form using a surface heating element formed of a strip shape, to provide excellent cohesiveness with respect to an object in which the heater is installed. In addition, the surface heater according to the present invention uses a low temperature surface heating element whose thermal density is low. As a result, the surface heater is coated by a thin film insulation layer, to thereby accomplish a generally thin film heater. Therefore, the surface heater according to the present invention can be easily attached on a surface-to-surface contact basis to any shapes of an object such as a circular pipe which anti-freezing is demanded, a rectangular storage chamber for use in a Kimchi refrigerator in which Kimchi is one of Korean traditional fermentation foods, or a plate-shaped radiator plate contacting an evaporator of a refrigerator as a defrost device. In addition, the surface heater according to the present invention transfers heat through the thin film insulation layer having a wide contact area, to thereby heighten a heat transfer efficiency of the heater and reduce electric power consumption of the heater.

In addition, in the case that the surface heater according to the present invention is applied as a defrost heater together with a radiator plate, the defrost heater employs a metal thin film surface heating element having a high temperature response performance and a low thermal density to thus make the heater excellent in view of safety since temperature on the surface of the heater is enough lower than an ignition point of a pro-environmental refrigerant, in which temperature of the defrost heater rapidly rises up at the time of performing a defrosting cycle and the defrost heater is rapidly cooled at the time of completion of the defrost cycle, to thus quickly resume a refrigerating cycle and greatly shorten time required for the defrosting cycle.

In addition, the present invention provided a surface heater and a fabricating method thereof, which uses a heating element and a coating insulation layer having an elasticity and thus can be fabricated in a spiral form, to thus provide a very easy and fast winding work with respect to a pipe and thereby provide an excellent workability and a high cohesiveness performance.

In addition, the present invention provides a surface heater and a fabricating method thereof, which uses an inexpensive Fe-based material, in particular, a Fe-based amorphous strip material which has a proper specific resistance value as a heat wire and is fabricated in a strip form to then be appropriate for heating at low temperature, to thus be inexpensively fabricated by a sequential production method, instead of using an expensive metallic material such as Ni.

BEST MODE

The above and/or other objects and/or advantages of the present invention will become more apparent by the following description.

Hereinbelow, a surface heater using a strip type surface heating element and a fabricating method thereof according to respective embodiments of the present invention will be described with reference to the accompanying drawings in detail.

Figure 1:
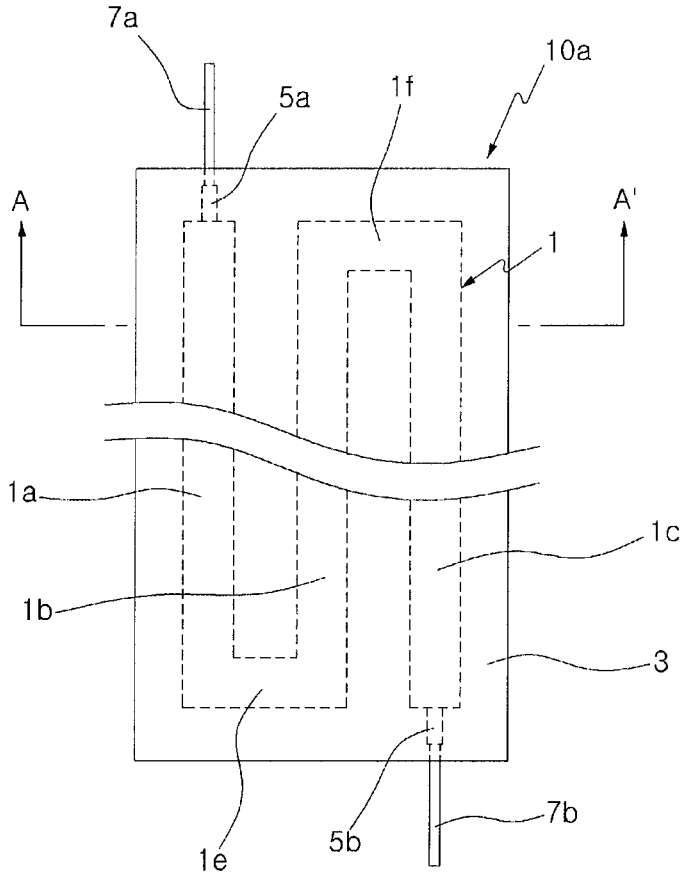
FIG. 1 is a plan view showing a surface heater use a strip type surface heating element according to a first embodiment of the present invention.
Figure 2:
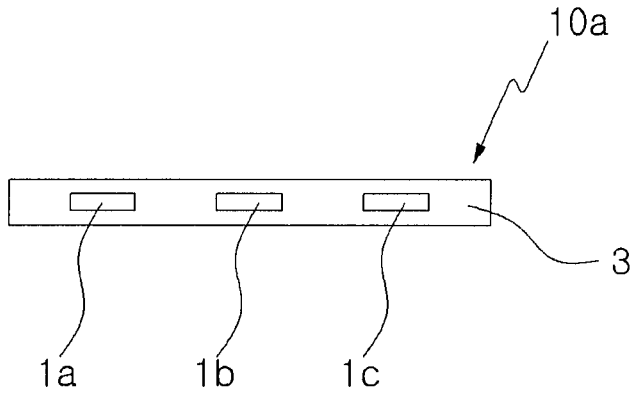
FIG. 2 is a sectional view cut along a line A-A' of FIG. 1.
Figure 3:
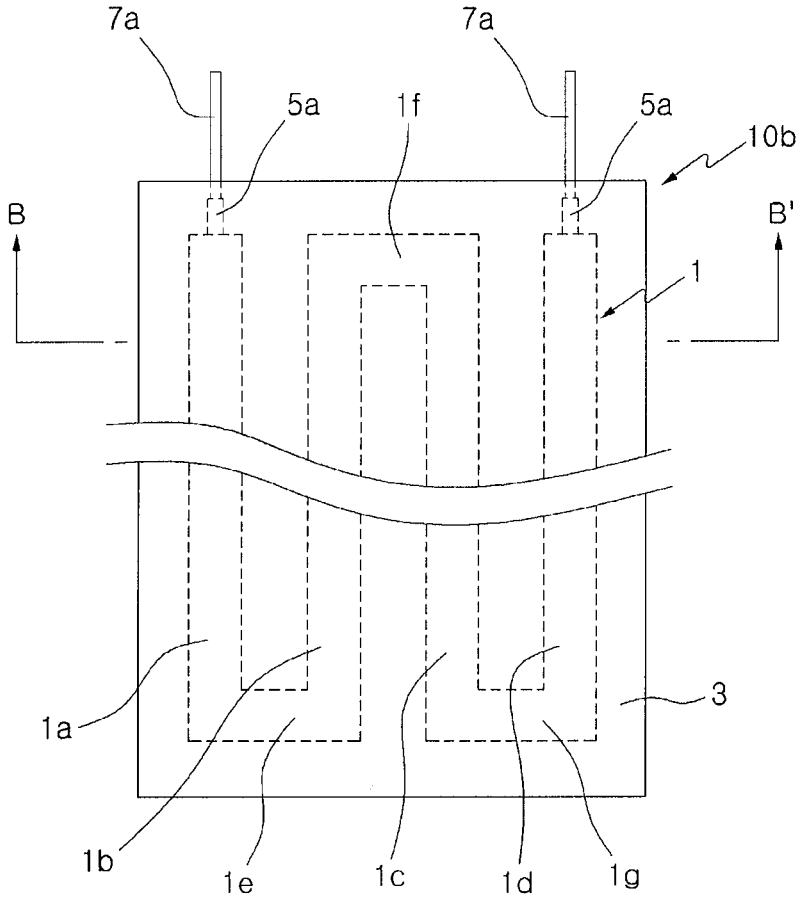
FIG. 3 is a plan view showing a surface heater use a strip type surface heating element according to a second embodiment of the present invention.
Figure 4:
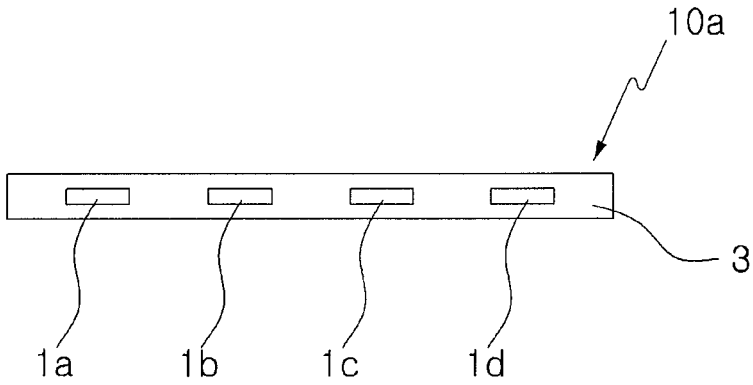
FIG. 4 is a sectional view cut along a line B-B' of FIG. 3.
Figure 5:
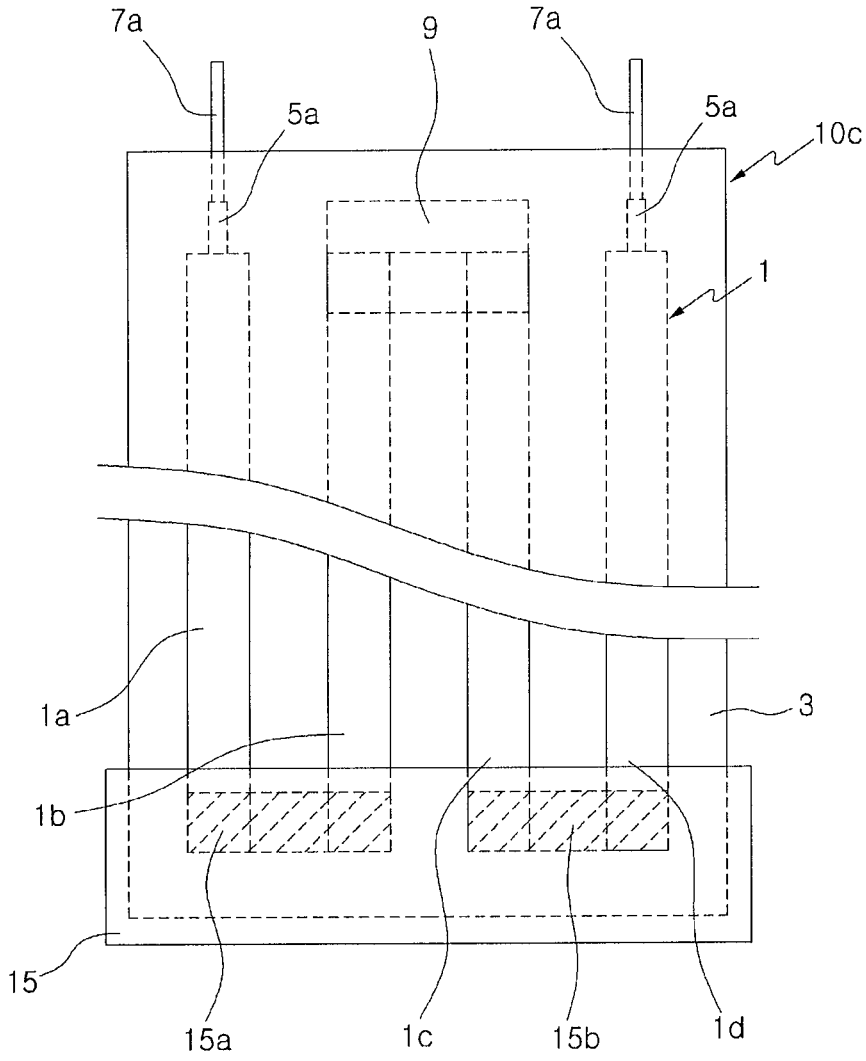
FIG. 5 is a plan view showing a surface heater using a strip type surface heating element according to a third embodiment of the present invention.
Figure 6:
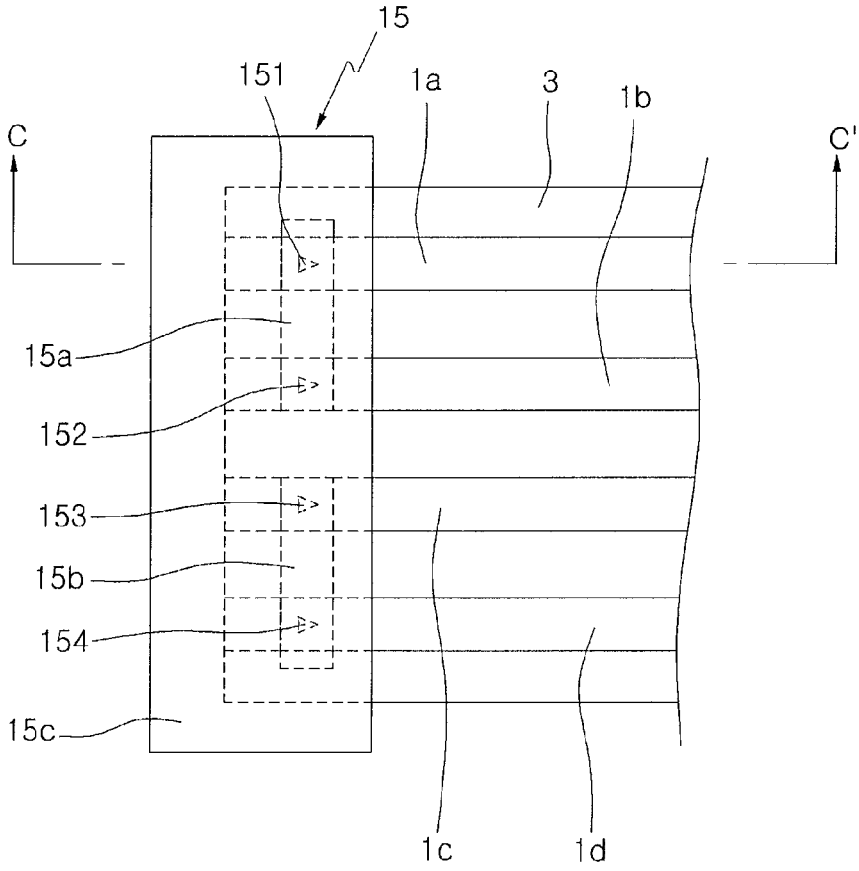
FIG. 6 is a plan view showing the surface heater of FIG. 5 in detail in which a serial connection unit is combined with the surface heater and the upper portion of a housing is removed.
Figure 7:
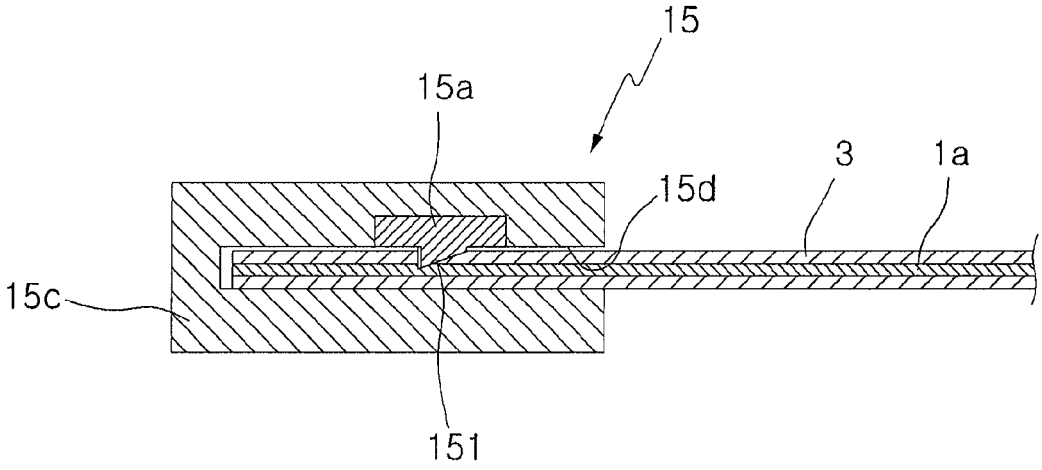
FIG. 7 is a sectional view cut along a line C-C' of FIG. 6.

FIG. 1 shows a surface heater use a strip type surface heating element according to a first embodiment of the present invention. FIG. 2 is a sectional view cut along a line A-A' of FIG. 1. FIG. 3 shows a surface heater use a strip type surface heating element according to a second embodiment of the present invention. FIG. 4 is a sectional view cut along a line B-B' of FIG. 3. FIG. 5 shows a surface heater using a strip type surface heating element according to a third embodiment of the present invention. FIG. 6 shows the surface heater of FIG. 5 in detail in which a serial connection unit is combined with the surface heater and the upper portion of a housing is removed. FIG. 7 is a sectional view cut along a line C-C' of FIG. 6.

Referring to FIGS. 1 through 7, a surface heater 10*a*, 10*b* or 10*c* using a strip type surface heating element according to respective embodiments of the present invention, includes: a strip type surface heating element 1 which emits heat when electric power is applied to both ends of at least one strip, and a number of strips 1*a*-1*d* are arranged with an interval in parallel with each other when the strip type surface heating element 1 is formed with a number of the strips 1*a*-1*d*, in which both side ends of the respective adjacent strips are connected mutually in a series or parallel connection method; and an insulation layer 3 which is coated on the outer circumference of the strip type surface heating element 1 in a plate shape.

In the case that the respective strips 1*a*-1*d* are connected in series, two ends of the respectively adjacent strips 1*a*-1*d* are connected by an integral connectors 1*e*-1*g*, respectively, as illustrated in the surface heaters of first and second embodiments of the present invention. Otherwise, two ends of the respectively adjacent strips 1*a*-1*d* are mutually connected by a serial connection unit 15 as illustrated in the surface heaters of a third embodiment of the present invention.

As shown in the surface heater 10*a* according to the first embodiment of the present invention of FIGS. 1 and 2, both first and second electric power terminals 7*a* and 7*b* of the strip type surface heating element 1 may be disposed at one side and the other side of the strip type surface heating element 1, respectively. As shown in the surface heater 10*b* according to the second embodiment of the present invention of FIGS. 3 and 4, both first and second electric power terminals 7*a* and 7*b* of the strip type surface heating element 1 may be disposed at one side of the strip type surface heating element 1.

Figure 15:
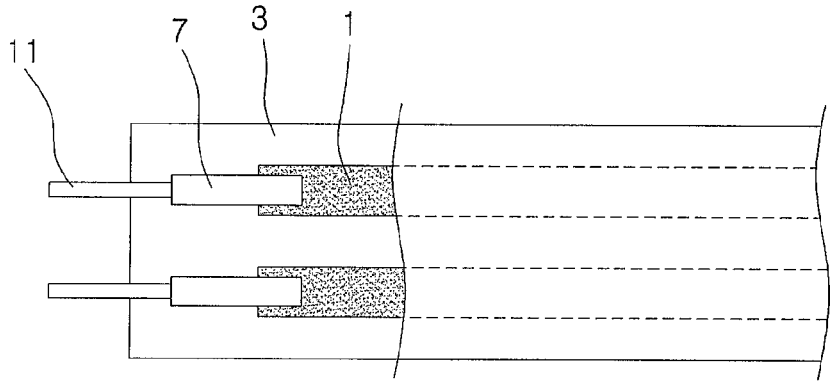
FIG. 15 is a plan view showing electric power terminals of the surface heater according to the present invention.

In this case, the electric power terminals 7*a* and 7*b* whose one end is respectively connected to a plug by an electric power cable 11, are spot-welded to the strip type surface heating element 1 as shown in FIG. 15, and thereafter are coated to seal the welded portions using an insulation film. Otherwise, when an electric power supply circuit becomes electrically shorted and thus overcurrent flows in the electric power supply circuit, as shown in FIGS. 1 to 3, it is possible to insert fuses 5*a* or 5*b* in any one place between one of the first and second electric power terminals 7*a* and 7*b* and one of the strips 1*a*, 1*c* and 1*d*, so that electric interruption can occur.

In addition, instead of a serial connection unit 8*a*, a bimetal 9 is installed in series in the middle of the respective strips 1*a*-1*d*, so that electric power applied to the first and second electric power terminals 7*a* and 7*b* is automatically interrupted when ambient temperature rises up above preset temperature, and electric power is automatically applied to the first and second electric power terminals 7*a* and 7*b* when ambient temperature falls down below preset temperature.

As described above, in the case that an electric current interruption unit such as a bimetal 9 or fuse is provided between one of the first and second electric power terminals 7*a* and 7*b* and the heating element 1, electric power is applied to the heating element 1 only within preset temperature. Otherwise, the fuse is melted when overcurrent flows in the electric power supply circuit, to cut off the electric power for the heating element 1, to accordingly prevent fire outbreak.

Figure 8:
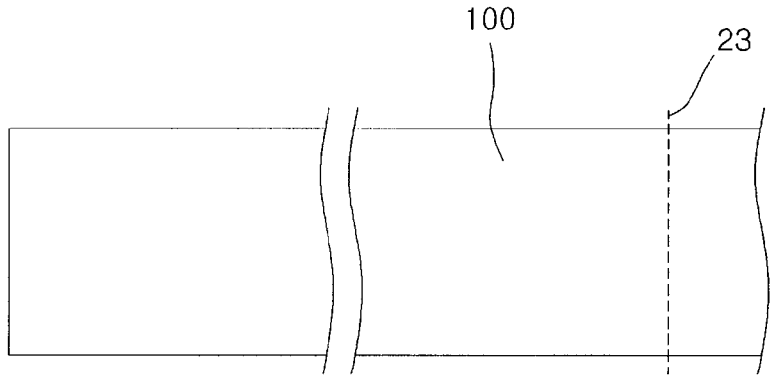
FIGS. 8 through 10 are plan views illustrating a slitting process of the strip type surface heating element which is applied to the present invention, respectively.
Figure 9:
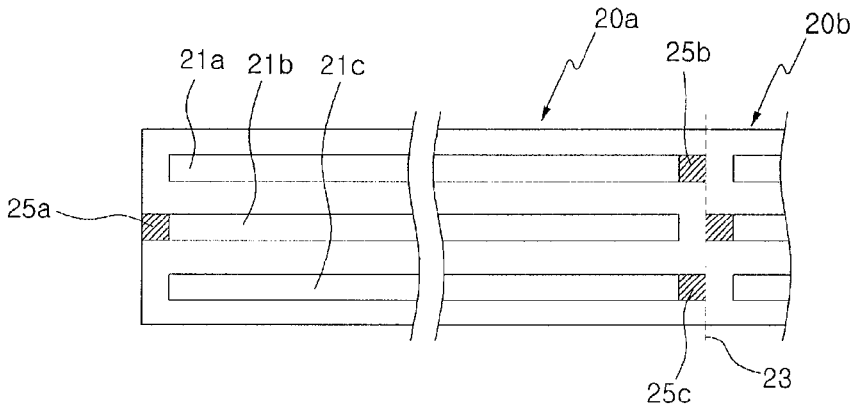
Figure 10:
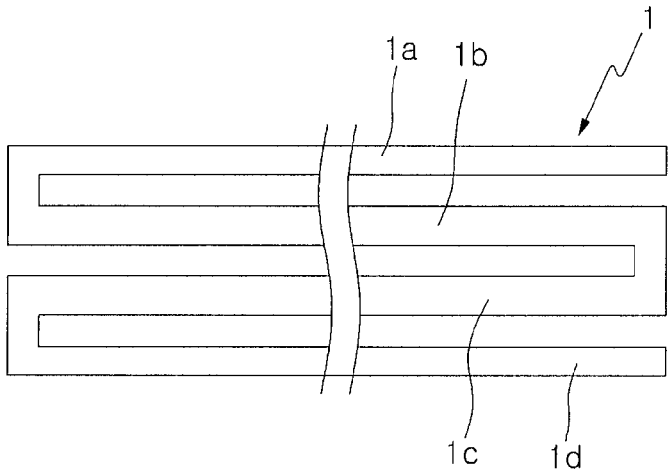

The respective surface heaters 10*a* and 10*b* according to the first and second embodiments of the present invention which are illustrated in FIGS. 1 and 3 use a slitting pattern formation method shown in FIGS. 8 to 10. Then, a thin film amorphous ribbon 100 is slitted into a pattern of a number of strips 1*a*-1*d* having a width of 0.5-200 mm so as to have a predetermined resistance value. Accordingly, the width of the ribbon is narrowed, and the overall length of the heating element is lengthened due to a series connection structure. As a result, the strip type surface heating element 1 is fabricated in which two electric power terminals are disposed at one side or both sides of the strip type surface heating element 1. Thereafter, the outer portion of the surface heating element 1 is lengthily coated using a pair of insulation films, to thus form an insulation layer 3.

Meanwhile, in the case of the surface heater 10*c* according to the third embodiment of the present invention illustrated in FIG. 5, a number of strips, for example, four linear strips, that is, first to fourth strips 1*a*-1*d* are fabricated. Thereafter, the ends of the second and third strips 1*b* and 1*c* are connected by using a bimetal 9 and the outer portion of the surface heating element 1 is coated to thus form an insulation layer 3, at one side of the surface heater 10*c*, and the ends of the first and second strips 1*a* and 1*b* and the ends of the third and fourth strips 1*c* and 1*d* are respectively connected by using conductive connectors 15*a* and 15*b* of a serial connection unit 15, at the other side of the surface heater 10*c*, to thus form a serially connected surface heating element 1 which is same as that of the second embodiment of the present invention.

As shown in FIGS. 6 and 7 in detail, the serial connection unit 15 has a structure that can connect the ends of the first and second strips 1*a* and 1*b* and the ends of the third and fourth strips 1*c* and 1*d* which are buried in the inside of the insulation layer 3 in a pattern that the serial connection unit 15 is simply fitted into the outer surface of the surface heating element 1, at a state where the insulation layer 3 has been formed at the outside of the surface heating element 1.

That is, the conductive connectors 15*a* and 15*b* of the serial connection unit 15 which connects the ends of the first and second strips 1*a* and 1*b* and the ends of the third and fourth strips 1*c* and 1*d* are integrally formed on the upper surface of a groove 15*d* in a housing 15*c* having a rectangular groove structure, at one side of the housing 15*c*. Four stoppers 151-154 whose leading end portions are sharp-pointed in the groove direction from the entrance side are integrally protrudingly formed on the respective conductive connectors 15*a* and 15*b* in correspondence to the first and second strips 1*a* and 1*b* and the third and fourth strips 1*c* and 1*d*.

Therefore, after a heater where the insulation layer 3 has been formed at the outside of the surface heating element 1 is inserted into the groove 15*d* of the serial connection unit 15, and then is retreated by a small amount of length, the stoppers 151 and 152 of the conductive connectors 15*a* and 15*b* are inserted into the insulation layer 3 to then be connected to the first and second strips 1*a* and 1*b*, and the stoppers 153 and 154 of the conductive connectors 15*a* and 15*b* are connected to the third and fourth strips 1*c* and 1*d*. Accordingly, the first and second strips 1*a* and 1*b*, and the third and fourth strips 1*c* and 1*d* are connected in series, and the heater would not be retreated beyond a degree by hindrance of the stoppers 151-154.

The strip type surface heating element 1 consists of any one selected from the group containing a single element metal thin plate of Fe, Al, Cu, etc., an iron-based (Fe—X) or iron chrome-based (Fe—Cr) metal thin plate, a FeCrAl alloy thin plate such as Fe-(14-21%)Cr-(2-10%)Al, a nichrome heat wire made of Ni (77% or more), Cr (19-21%) and Si (0.75-1.5%) or Ni (57% or more), Cr (15-18%), Si (0.75-1.5%), and Fe (remaining part), and an amorphous thin plate (ribbon).

Preferably, a Fecalloy alloy (product name; KANTHAL™) which is mixed at a ratio of Fe-15Cr-5Al or Fe-20Cr-5Al-REM (rare earth metal) (here, including REM (Y, Hf, Zr) of 1% or so) can be used as an alloy material of the FeCrAl alloy thin plate.

In addition, the amorphous thin plate is made of a Fe-based or Co-based amorphous material. Since the Fe-based amorphous material is relatively inexpensive, the Fe-based amorphous alloy material is more preferable than the Co-based amorphous alloy material.

The Fe-based amorphous material is, for example, $Fe_{100-u-y-z-w}R_uT_xQ_yB_zSi_w$. Here, R includes at least one selected from the group containing Ni and Co, T includes at least one selected from the group containing Ti, Zr, Hf, V, Nb, Ta, Mo and W, Q includes at least one selected from the group containing Cu, Ag, Au, Pd and Pt, u is a value within a range of 0-10, x is a value within a range of 1-5, y is a value within a range of 0-3, and z is a value within a range of 5-12, and w is a value within a range of 8-18.

The Co-based amorphous material is, for example, $CO_{1-x1-x2}Fe_{x1}M_{x2})_{x3}B_{x4}$. Here, M includes at least one selected from the group containing Cr, Ni, Mo and Mn, and x1, x2, and x3 have a value within a range of $0 \le x1 \le 0.10$, $0 \le x2 \le 0.10$, and $70 \le x3 \le 79$, respectively. In an amorphous alloy having the above-defined composition, x4 which is a composition ratio of B has a value within a range of $11.0 \le x1 \le 13.0$.

The most desirable material among the materials of the strip type surface heating element 1 is a Fe-15Cr-5Al or Fe-based amorphous material. In the case that the Fe-15Cr-5Al amorphous material is thermally treated, an $Al_2O_3$ (alumina) oxide insulation film is formed on the surface of the strip type surface heating element 1. Accordingly, the strip type surface heating element 1 made of the Fe-15Cr-5Al amorphous material has a high temperature corrosion-resistant property to thus solve an oxidation problem of the Fe-based material inexpensively.

In addition, the specific resistance of NIKROTHAL™ (Ni: 80) which is a nichrome (NiCr) heat wire among the well-known high temperature heat wire materials is known as 1.09 $\Omega mm^2/m$, and the specific resistance of KANTHAL™ D is known as 1.35 $\Omega mm^2/m$. By the way, since the specific resistance of the Fe-based amorphous thin plate (ribbon) is 1.3-1.4 $\Omega mm^2/m$ similar to that of the KANTHAL™ heat wire, it can be seen that the Fe-based amorphous thin plate (ribbon) has an excellent characteristic as a heat wire material. Further, since the Fe-based amorphous thin plate (ribbon) is relatively inexpensive in comparison with the KANTHAL™ heat wire, the Fe-based amorphous thin plate (ribbon) is used as a material of the strip type surface heating element 1, in the present invention.

However, any metal or alloy materials may be used as the material of the strip type surface heating element 1, if they have a specific resistance value which is required as a heat wire property and are inexpensively available in the market, respectively.

Meanwhile, the amorphous thin plate (ribbon) is obtained by spraying a molten alloy of an amorphous alloy into a high speed rotating cooling roll by a liquid quenching technique, for example, and cooling and peeling the same at a cooling rate of $10^6$K/sec, and is made into 10-50 μm thick and 20-200 mm wide. In addition, the amorphous material has excellent material properties of high strength, high corrosion-resistance, high soft magnetism, etc., and the Fe-based amorphous ribbon can be purchased inexpensively at about half a cost when compared with a conventional silicon heater or nichrome wire heater.

As described above, the amorphous thin plate (ribbon) is obtained into an amorphous thin plate of 10-50 μm, and thus has a surface area more than 10-20 times when compared with other coil type heat wires having the same surface area as that of the amorphous thin plate (ribbon). Accordingly, when the amorphous thin plate (ribbon) emits heat using identical electric power, heat is emitted at low temperature over a wide area. As a result, the amorphous thin plate (ribbon) is suitable for a low temperature heating material. That is, because the amorphous ribbon is formed of a thin plate, a thermal density that represents heat which is emitted per 1 $cm^2$ is low, and an amount of calorie is low. Therefore, the strip type surface-shaped heater 1 that is produced by processing the amorphous ribbon made of the thin plate in this invention does not need to form a thick heat-resistant coating layer on the outer circumference of the heater, as the insulation layer 3, considering relatively excess and/or high temperature heat emission, when compared with the conventional coil type heat wires.

Figure 16:
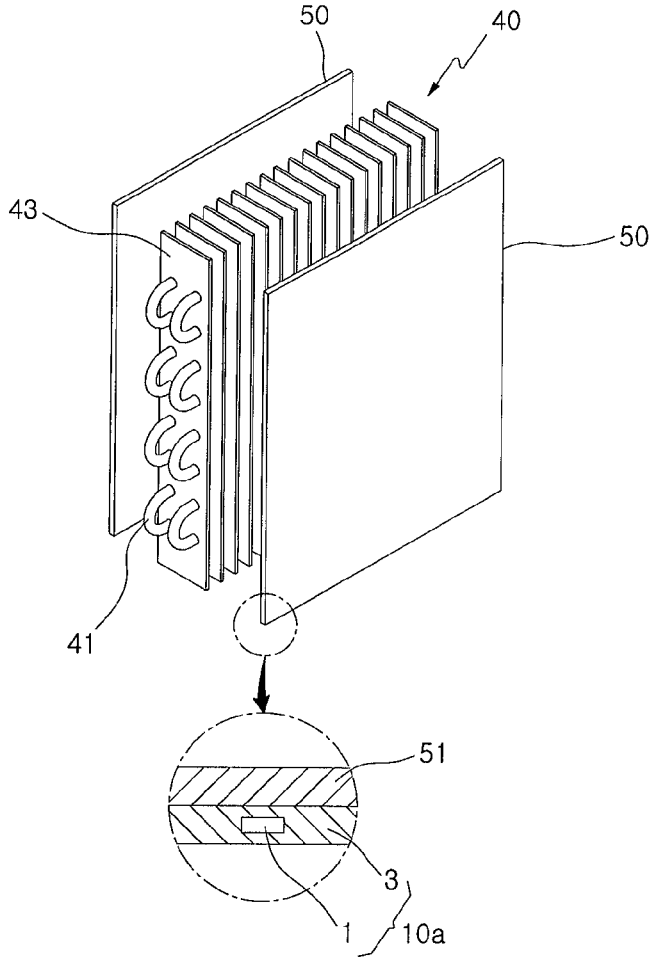
FIG. 16 is a perspective view showing the surface heater according to the present invention which is applied to a defrost heater.

In addition, the surface heater which is manufactured by using the surface heating element 1 according to the present invention can be easily attached on a surface-to-surface contact basis to any shapes of an object such as an anti-freezing circular pipe, a rectangular storage chamber for use in a Kimchi refrigerator in which Kimchi is one of Korean traditional fermentation foods, or a plate-shaped radiator plate 51 contacting an evaporator 40 of a refrigerator as a defrost heater 50 shown in FIG. 16. In addition, the surface heater according to the present invention transfers heat through the thin film insulation layer 3 having a wide contact area, to thereby heighten a heat transfer efficiency of the heater and reduce electric power consumption of the heater.

Further, in the case that the surface heater 10*a* according to the present invention is applied as a defrost heater 50 together with a radiator plate 51, the defrost heater employs a metal thin film surface heating element having a high temperature response performance and a low thermal density to thus make the heater excellent in view of safety since temperature on the surface of the heater is enough lower than an ignition point of a pro-environmental refrigerant, in which temperature of the defrost heater rapidly rises up at the time of performing a defrosting cycle and the defrost heater is rapidly cooled at the time of completion of the defrost cycle, to thus quickly resume a refrigerating cycle and greatly shorten time required for the defrosting cycle.

In addition, synthetic resin having excellent heat resistance and electric insulation properties can be used as a material of the insulation layer 3 which is coated on the outer surface of the strip type surface heating element 1 to perform a moisture-proof, heat-resistance and electric insulation function. For example, various electric insulation film materials such as PE (Polyethylene), PP (Polypropylene), PET (Polyethylene Terephthalate) which is obtained by polymerizing TPA (Terephthalic Acid) and MEG (Mono-ethylene Glycol), polyimide or silicon, can be used as the materials for the insulation layer.

The synthetic resin which is used as the material of the insulation layer 3 is usually relatively inexpensive and has excellent electric insulation, thermal stability, water-resistance properties. The silicon has also excellent heat resistance, tensile strength, expansion and contraction capability and abrasion-resistance properties.

Meanwhile, as shown in FIGS. 1 to 10 in this invention, the ribbon 100 of a broad width is slitted into strips 1*a*-1*d* having a width of 0.5-200 mm, in order to have a resistance value which is suitable when the ribbon has a predetermined length such as 1 m, 2 m, 5 m or more and emits heat at a predetermined temperature. By doing so, it is necessary that the width of the heater becomes narrow and the overall length thereof becomes long.

Hereinbelow, a method of manufacturing a surface heater using the strip type surface heating element according to this invention will be described.

Figure 11:
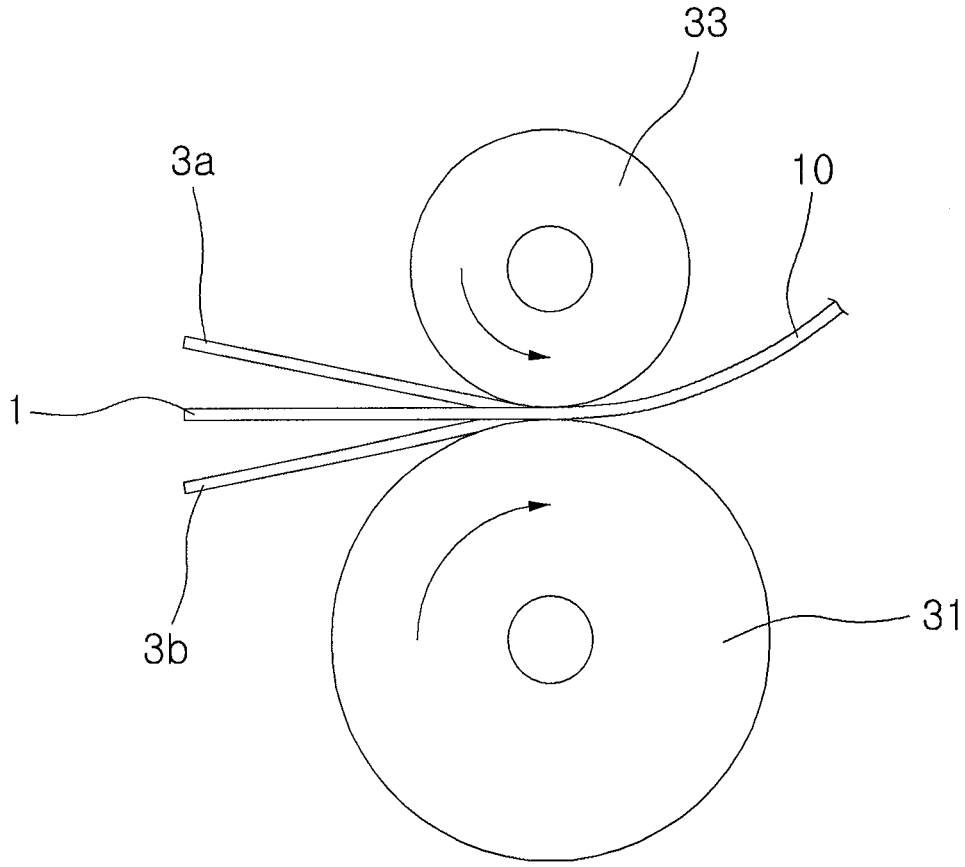
FIGS. 11 and 12 are a sectional view and a plan view illustrating a laminating process of the surface heater using the strip type surface heating element according to the embodiment of the present invention, respectively.
Figure 12:
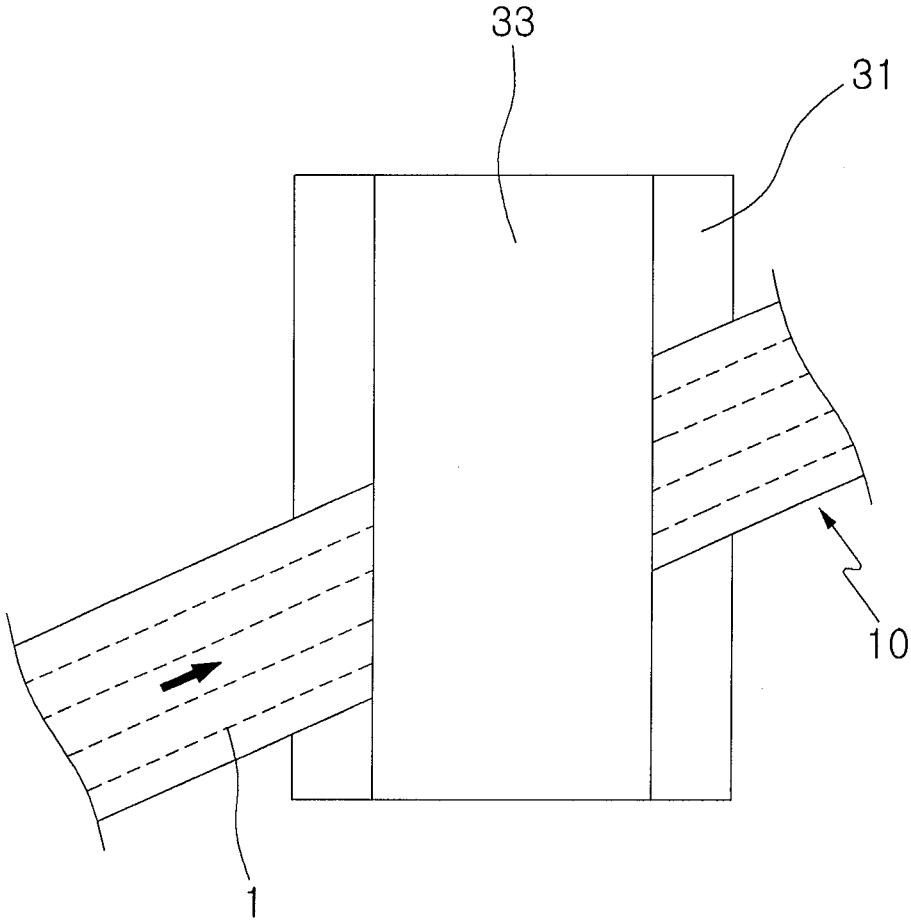
Figure 13:
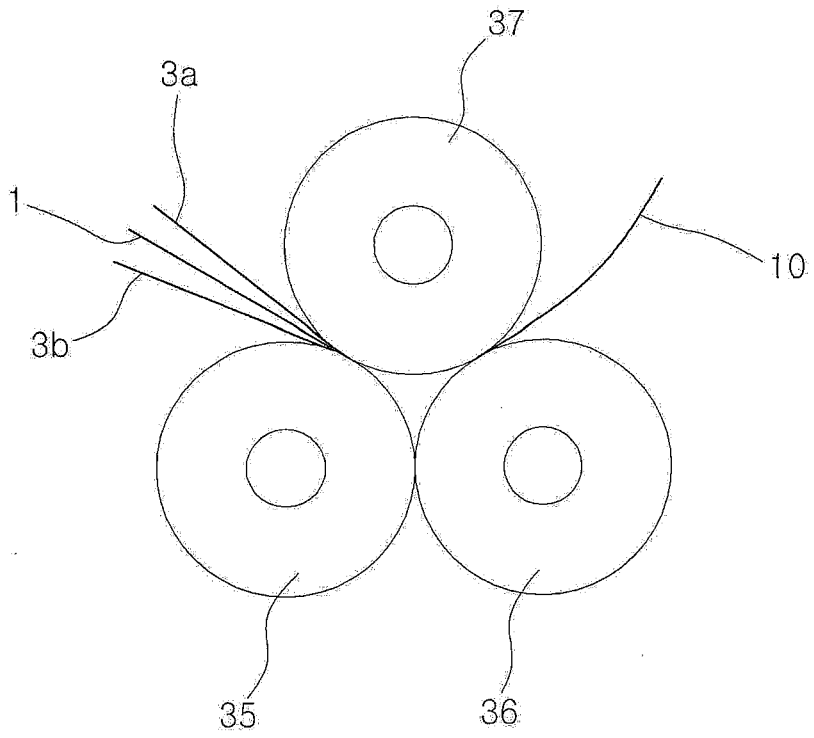
FIG. 13 is a sectional view illustrating a laminating process of the surface heater using the strip type surface heating element according to another embodiment of the present invention.
Figure 14:
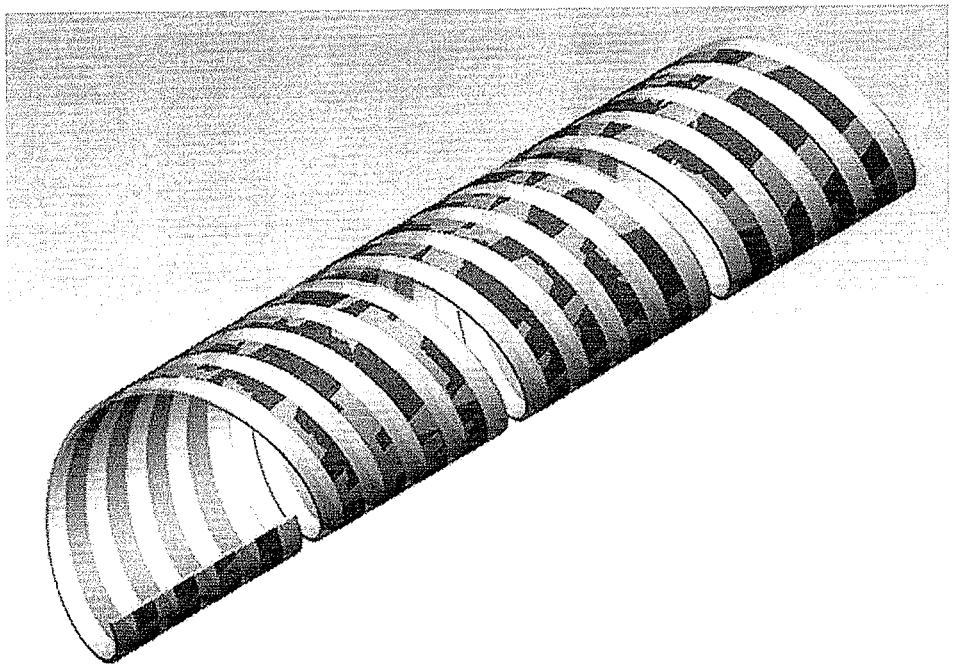
FIG. 14 is a perspective view showing a spiral surface heater that is obtained through the laminating process of FIG. 11.

FIGS. 8 through 10 are plan views illustrating a slitting process of the strip type surface heating element which is applied to the present invention, respectively. FIGS. 11 and 12 are a sectional view and a plan view illustrating a laminating process of the surface heater using the strip type surface heating element according to the embodiment of the present invention, respectively. FIG. 13 is a sectional view illustrating a laminating process of the surface heater using the strip type surface heating element according to another embodiment of the present invention. FIG. 14 is a perspective view showing a spiral surface heater that is obtained through the laminating process of FIG. 11.

First, referring to FIGS. 8 to 10, a method of manufacturing the serially connected strip type surface heating element 1 shown in FIG. 3 according to this invention will be described.

A broad width amorphous ribbon 100 is of a small resistance value. Accordingly, in the case that length of the heater is short, it is required that the strip type surface heating element 1 be slitted in a pattern of the strips 1*a*-1*d* having a width of 1-5 mm for example, so as to have a predetermined resistance value, to thus make the width of the ribbon narrowed, and the overall length of the heating element lengthened due to a series connection structure.

In this case, since the resistance value and length of the surface heaters 10*a*-10*c* are previously established, the slitting width of the respective strips 1*a*-1*d* is established to increase in proportion to the length of the respective heaters.

First, if the broad width ribbon 100 which is wound in a coil shape is consecutively supplied as shown in FIG. 8, three blanks 21*a*-21*c* are formed on the ribbon 100 by a punching process three times in every unit length as shown in FIG. 9. Then, when the rear end of the unit length ribbon is transferred, the transferred unit length ribbon is cut along a cutting line 23, to thus consecutively obtain the unit length ribbons 20*a* and 20*b* in which three, that is, the first to third blanks 21*a*-21*c* have been formed.

Thereafter, a first region 25*a* which is lengthily located from the second blank 21*b* which is located at the center of one side end of the unit length ribbons 20*a*, and second and third regions 25*b* and 25*c* which are lengthily located from the first and third blanks 21*a* and 21*c* which are located at both end sides of the other side of the unit length ribbons 20*a*, are punched on the unit length ribbons 20*a* shown in FIG. 9, as illustrated as three shading pattern portions in FIG. 9. Accordingly, four strips 1*a*-1*d* are connected in series as shown in FIG. 10. Thus, the overall length of the heating element is extended and the resistance value of the heating element is increased, to resultantly obtain a pattern of the strip type surface heating element 1 to one side of which two power terminal terminals can be connected.

FIGS. 11 and 12 illustrate a laminating process of a spirally shaped surface heater using the strip type surface heating element according to the embodiment of the present invention, respectively.

As shown in FIGS. 11 and 12, a surface heater having a spiral shape can be manufactured by using two silicon rolls 31 and 33 whose diameters differ from each other and in which a heater is contained, respectively. That is, synthetic resin films 3*a* and 3*b* which can be used as the material of the insulation layer 3 are overlapped at the upper and lower sides of the strip type surface heating element 1, respectively, and then are made to pass through for example, the silicon rolls 31 and 33 which are set at 100-200° C. slantly as shown in FIG. 12. Then, a spirally shaped surface heater is obtained as shown in FIG. 14.

In this case, diameter of the thus-obtained spirally shaped surface heater is determined according to difference between diameters of the silicon rolls 31 and 33 which are respectively arranged on the upper and lower portions of the heater 10.

As illustrated in FIG. 13, a spirally shaped surface heater can be obtained through a laminating process by using a combination of three silicon rolls 35, 36 and 37 whose diameters are same and in which a heater is contained, respectively.

When the spirally shaped surface heater is wound around a pipe, a winding workability becomes very high and a cohesiveness with respect to the pipe becomes high, since the spirally shaped surface heater is formed of a spiral shape, and the strip type surface heating element 1 and the insulation layer 3 of the synthetic resin films 3*a* and 3*b* which are laminated on the strip type surface heating element 1 are entirely formed in a thin film of 0.2-1 mm thick and are of an elastic performance. In this case, it is preferable that diameter of the surface heater of the spiral shape is somewhat smaller than that of the pipe.

Meanwhile, general flat surface heaters 10*a*-10*c* are obtained by overlapping synthetic resin films 3*a* and 3*b* which can be used as the materials of the strip type surface heating element 1 and the insulation layer 3 and making the overlapped synthetic resin films 3*a* and 3*b* pass through the upper and lower silicon rolls whose diameters are same and in which a heater is contained, perpendicularly with the axis of the rolls.

The surface heaters 10*a*-10*c* using the strip type surface heating element according to the first to third embodiments of the present invention can be formed into a thin film of 0.2-1 mm thick and 10 mm to 200 mm or more wide.

Therefore, when the first and second power terminals 7*a* and 7*b* are connected with both ends of the strip type surface heating element 1 and an alternating-current (AC) or direct-current (DC) power source is connected between the first and second power terminals 7*a* and 7*b*, the heating element 1 can be heated in the range of 30-50° C., to thus prevent the surface heater wound pipe from being frozen to burst.

In this case, a surface heater according to the present invention is embodied in a thin film form using a surface heating element formed of a strip shape, to provide excellent cohesiveness with respect to a pipe. In addition, the surface heater according to the present invention uses a low temperature surface heating element 1 whose thermal density is low. As a result, the surface heater is coated by a thin film insulation layer 3, to thereby accomplish a generally thin film heater 10*a*, 10*n* or 10*c*. Thus, the surface heater according to the present invention has a wide contact area with respect to a pipe and transfers heat through the thin film insulation layer 3, to thereby heighten a heat transfer efficiency of the heater and reduce electric power consumption of the heater.

In addition, the surface heater according to the present invention can be applied to prevent a pipe from being frozen to burst. Further, the surface heater according to the present invention can be used as a rectangular storage chamber for use in a Kimchi refrigerator in which Kimchi is one of Korean traditional fermentation foods, or a defrost device which removes frost sticked into an evaporator of a refrigerator.

FIG. 16 is a perspective view showing the surface heater according to the present invention which is applied to a defrost heater. Referring to FIG. 16, the evaporator 40 has a structure that a number of radiation fins 43 are combined with the outside of a tube 41 through which a refrigerant passes.

In this case, a defrost heater 50 of a plate shape is combined to contact both sides of the evaporator 40, and includes an aluminium radiator plate 51 of a plate shape which contacts the evaporator 40 of the refrigerator to thus perform a thermal conduction process, and a surface heater 10*a* that is attached to the radiator plate 51.

When the surface heater 10*a* according to the present invention is applied as the defrost heater 50 together with the radiator plate 51, the surface heater 10*a* employs a metal thin film surface heating element having a high temperature response performance and a low thermal density to thus make the heater excellent in view of safety and the heater temperature control unnecessary since temperature on the surface of the heater (113° C. in case of a 180 W heater) is enough lower than an ignition point of a pro-environmental refrigerant, for example, R600a (refrigerant boiling point is 460° C.).

Further, when the surface heater 10*a* according to the present invention is applied as the defrost heater 50, temperature rapidly rises up at the time of performing a defrosting cycle and the heater is rapidly cooled at the time of completion of the defrost cycle, to thus quickly resume a refrigerating cycle and greatly shorten time required for the defrosting cycle.

Mode For Invention

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

Industrial Applicability

As described above, a surface heater using a strip type surface heating element according to the present invention may be applied to a heater which can prevent a pipe through which fluid flows from being frozen to burst, and which regulates temperature of or a storage chamber of a Kimchi refrigerator, in various forms.

The invention claimed is:

1. A flexible strip surface heater comprising:

a number of strip surface heating elements arranged in parallel along a length of the strip surface heater and spaced apart from each other, the strip surface heating element being formed of an Fe-based amorphous alloy thin-film;

a strip insulation layer coated on the outer circumference of the number of the strip surface heating elements; and a serial connection unit which electrically connects the adjacent strip surface heating elements in series, wherein the serial connection unit comprises:

a housing having a rectangular groove into which one end of the strip insulation layer is inserted; and a conductive connector having stoppers, leading end portions of the stoppers being sharp-pointed and protruding inside the groove in such a manner that the leading end portion penetrate the strip insulation layer and contact with the strip surface heating elements, to thereby electrically connect the adjacent strip surface heating elements via the stoppers and the conductive connector.

2. The flexible strip surface heater according to claim 1, wherein the flexible strip surface heater has a spiral form.

3. The flexible strip surface heater according to claim 1, wherein the strip insulation layer is formed of a synthetic resin.

4. The flexible strip surface heater according to claim 1, further comprising a heat radiator layer adhered to one side surface of the strip insulation layer.

* * * * *